United States Patent [19]

Belsak et al.

[11] Patent Number: 4,968,346

[45] Date of Patent: Nov. 6, 1990

[54] METHOD FOR ELUTING ADSORBED GOLD FROM CARBON

[75] Inventors: Anthony L. Belsak, York; Narendrakumar C. Desai, Hershey; Thomas F. McConnell, Etters, all of Pa.; Curt A. Williams, Raleigh, N.C.

[73] Assignee: E. I. Du Pont de Nemours and Company, Wilmington, Del.

[21] Appl. No.: 414,818

[22] Filed: Sep. 29, 1989

[51] Int. Cl.[5] ..... C22B 11/04

[52] U.S. Cl. ..... 423/29; 423/25; 423/30; 423/31; 210/673; 210/688; 210/912

[58] Field of Search ..... 75/118 R, 105, 101 BE; 423/25, 29, 30, 31; 210/673, 688, 912

[56] References Cited

U.S. PATENT DOCUMENTS

| | | | |
|---|---|---|---|
| 2,753,258 | 7/1956 | Burstall et al. | 75/118 |
| 3,018,176 | 1/1962 | Zima | 75/118 |
| 3,317,313 | 5/1967 | Buggs et al. | 75/118 |
| 3,625,674 | 12/1971 | Jacobs | 75/101 |
| 3,709,681 | 1/1973 | Wilson | 75/109 |
| 3,778,252 | 12/1973 | Wilson | 75/101 R |
| 3,826,750 | 7/1974 | Wilson | 252/187 R |
| 3,869,280 | 3/1975 | Langlois | 75/0.5 A |
| 3,882,018 | 6/1975 | Depree | 210/20 |
| 3,892,557 | 7/1975 | Lutz et al. | 75/0.5 A |
| 3,935,006 | 1/1976 | Fischer | 75/118 R |
| 3,992,197 | 11/1976 | Wetzold | 75/118 R |
| 4,163,664 | 8/1979 | Ugo | 75/108 |
| 4,208,378 | 6/1980 | Heinen et al. | 423/27 |
| 4,329,321 | 5/1982 | Dalton, Jr. et al. | 423/22 |
| 4,372,830 | 2/1983 | Law | 204/110 |
| 4,375,984 | 3/1983 | Bahl et al. | 75/97 A |
| 4,468,303 | 8/1984 | Griffin et al. | 204/109 |
| 4,528,166 | 7/1985 | McDougall | 423/23 |
| 4,571,265 | 2/1986 | Konig et al. | 75/108 |
| 4,615,736 | 10/1986 | Armor et al. | 75/251 |

OTHER PUBLICATIONS

William H. Waitz, Jr., "Recovery of Precious Metals with Amberlite Ion Exchange Resins", Amber-hi-lites, No. 171, Autumn 1982.

William H. Waitz, Jr., "Ion Exchange for Recovery of Precious Metals", Plating and Surface Finishing, pp. 56–59.

*Primary Examiner*—Robert L. Stoll

[57] ABSTRACT

Gold in a very dilute water solution is carbon filtered to capture the gold by adsorption; the gold in the filter is then recovered from the carbon by means of a highly-efficient non-explosive low-alcohol water-based eluant including a strong base and an elevated level of sodium or potassium cyanide.

8 Claims, 4 Drawing Sheets

METHOD FOR ELUTING ADSORBED GOLD FROM CARBON

BACKGROUND OF THE INVENTION

This invention relates to gold recovery, and more particularly to eluting gold from carbon filters.

It is well known in gold-using industries that activated carbon, e.g. coconut shell carbon, is useful for adsorbing gold from dilute solutions containing gold that might otherwise be discarded. U.S. Pat. No. 3,935,006 issued to D. D. Fischer on Jan. 27, 1976, and an improvement thereon, U.S. Pat. No. 4,208,378 issued to H. J. Heinen et al. on June 17, 1980 (both incorporated herein by reference) comprise the closest prior art known to Applicants relating to the instant invention.

Fischer introduces the idea of employing caustic-alcohol-water mixtures, containing relatively large percentages of alcohol, e.g. 40 to 100% by volume, for desorbing gold from activated carbon. Using Fischer's approach with eluants containing more than 25% by volume of water, "the efficiency of elution is sharply decreased".

Heinen et al. describe a method employing a much lower percentage of alcohol in the eluant solution, e.g. "preferably about 20 to 30% by volume", along with 1 to 2% (by weight) of sodium hydroxide and also sometimes containing "a small amount of sodium cyanide, e.g. about 0.02 to 0.1 percent (by weight) of the water solution". The approach of Heinen et al. also requires elution to occur at elevated temperatures, e.g. about 80° to 90° C. (i.e. 176° to 194° F.).

Both of the above-mentioned techniques have been successfully demonstrated to desorb 98% or more of the gold from loaded carbon. They both, however, include a limitation that seriously complicates practical implementation: both use relatively high levels of alcohol in the eluant. In fact, both show improved performance with higher levels of alcohol. Eluants with alcohol contents above about 3% are potentially explosive, especially at elevated temperatures (i.e. 100° F. and above). Therefore, it is necessary to employ expensive special apparatus to prevent any eluant contact with air. It is quite inconvenient and requires expensive explosion-proof installations to prepare and use such hazardous materials. It is therefore an object of the instant invention to provide a safer and more efficient method for eluting adsorbed gold from carbon using an eluant containing only a relatively small amount of alcohol.

SUMMARY OF THE INVENTION

The instant invention provides an improved method for recovering gold which has been adsorbed onto carbon. The method is relatively safe and simple, and allows for the reuse of the carbon indefinitely without significant loss in its adsorptivity.

Applicants have discovered that it is possible to accomplish high-efficiency (i.e. 95% or more) elution of gold adsorbed on carbon using an eluant containing only about 2% to 3% alcohol (by volume) and 97% to 98% deionized water (by volume). The novel approach comprises adding to the eluant at least 2.5% (by weight) (i.e. at least 25 grams per liter) of a strong base and at least 0.3% (by weight) (i.e. at least 3 grams per liter) of sodium cyanide or potassium cyanide. The base causes the eluant's pH to be raised well above 11, and supresses the release of free cyanide gas. The eluant thus formulated is heated to a temperature about 160° F. and then passed through a column of gold-laden carbon. After elution, the gold-rich eluant solution (i.e. about one-half troy ounce of gold per gallon) is cooled and stored for later processing to chemically precipitate the gold from the eluant by traditional means. The carbon column is then simply rinsed with fresh deionized water to prepare the carbon for another cycle of adsorption and elution. Thus employed, the carbon column can be reused indefinitely.

BRIEF DESCRIPTION OF THE DRAWING

The invention will be further elucidated by reference to the following Detailed Description in conjunction with the accompanying Drawing, in which.

DETAILED DESCRIPTION OF A PREFERRED EMBODIMENT

Gold dissolved in water with a gold concentration of one hundred parts per million or less is commonly encountered in gold-using industries (e.g. in the electronics and jewelry industries), typically in rinse water resulting from gold plating processes. Direct chemical precipitation or plating out of the gold from such dilute solutions is tedious and economically impractical. The preferred approach is to pass the dilute solution through an activated carbon (e.g. coconut shell carbon) filter in order to cause the dissolved gold to be adsorbed onto the surface of the carbon. Typically, a flow of 6 gallons per minute through a loosely packed fifty-pound activated carbon column (with a cross section of about one quarter of a square foot) will result in the adsorption of more than 98% of the dissolved gold onto the carbon up to a maximum adsorption level of about one troy ounce per pound of carbon. For a gold solution of one hundred parts per million, this corresponds to processing about four thousand gallons of dilute gold rinse water per fifty pound carbon cannister. For less concentrated gold solutions, correspondingly more solution can be filtered per cannister.

Once a carbon cannister has adsorbed its maximum amount of gold, it is replaced by a fresh carbon cannister. Each full (or "loaded") cannister contains about fifty troy ounces of gold (i.e. about twenty thousand U.S. dollars worth at current prices). The next step is to desorb the adsorbed gold from the carbon with an efficient eluant so that after elution the eluant contains a highly concentrated level of gold, i.e. at least one fourth troy ounce per gallon of eluant, or, in other words, more than twenty times more gold-concentrated than the original rinse water. The gold is then readily and economically precipitated from the eluant by well-known chemical means.

Figure 1:
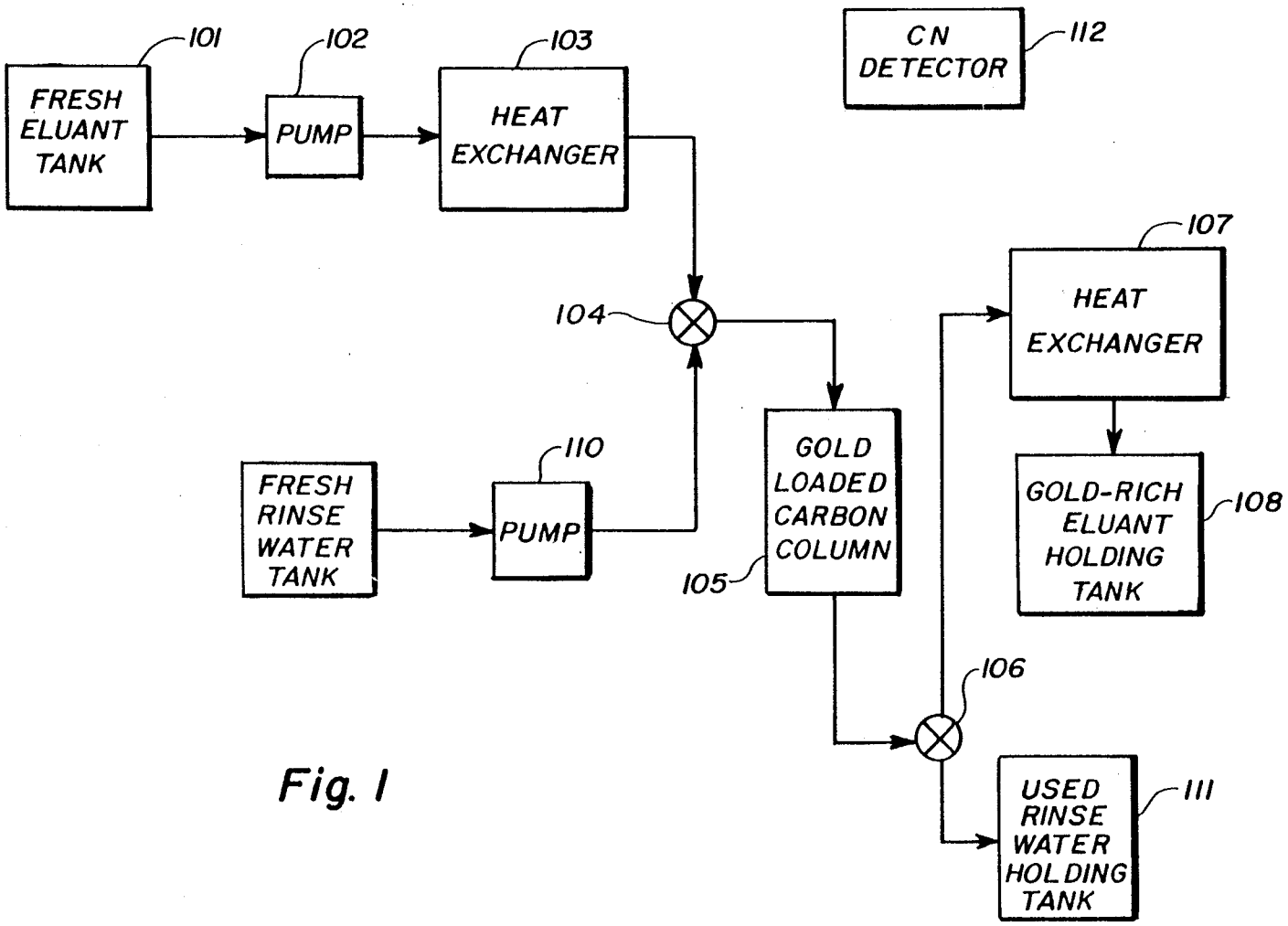
FIG. 1 is a block diagram showing the basic steps of a preferred elution process.

The key to carrying out the process described above in a safe and efficient manner is the use of an eluant that is highly effective for desorbing gold from carbon while at the same time being non-explosive and not prone to the production of poisonous gases. Such a preferred eluant, discovered by applicants, consists substantially of an aqueous solution of alcohol, a strong base, and sodium or potassium cyanide. Sodium hydroxide and potassium hydroxide are preferred strong bases. A particularly preferred eluant consists essentially of:

98% deionized water (by volume)
2% N-propanol (by volume)
30 grams per liter of sodium hydroxide
6 grams per liter of sodium cyanide Referring to FIG. 1, the preferred basic process employed by Applicants is shown in block diagram form. Fresh eluant, concocted substantially as described above, is transferred from tank 101 via low pressure pump 102 through steam heat exchanger 103 which raises the eluant temperature to about 180° F. The heated eluant then flows through selector valve 104 and through the gold-laden activated carbon column 105, desorbing the gold as described above. The gold-rich eluant then passes through selector valve 106 and is cooled by heat exchanger 107 before being stored in holding tank 108. This dual heat exchanger design minimizes the amount of the eluant being heated and maintains the storage tank volumes at room temperature. Subsequent rinsing of the carbon can be accomplished by switching both of the selector valves 104 and 106 and pumping fresh deionized rinse from tank 109 via low pressure pump 110 through the cannister of carbon that has been desorbed of gold. The rinse water is stored in holding tank 111 for future processing (possibly as part of a dilute gold solution bound for adsorption on a fresh cannister of carbon). The entire process is performed under the careful supervision of a skilled technician. As an extra safety precaution, a highly-sensitive cyanide gas detector 112 is installed in the direct vicinity of the elution apparatus to make sure that no poisonous gas is wafting through the air that might injure the technician. Use of this system results in economical reclamation of gold in dilute aqueous solution with negligible losses.

Applicants tried several variations during their experiments that led to the above-described preferred eluant:

EXAMPLE 1

Figure 2:
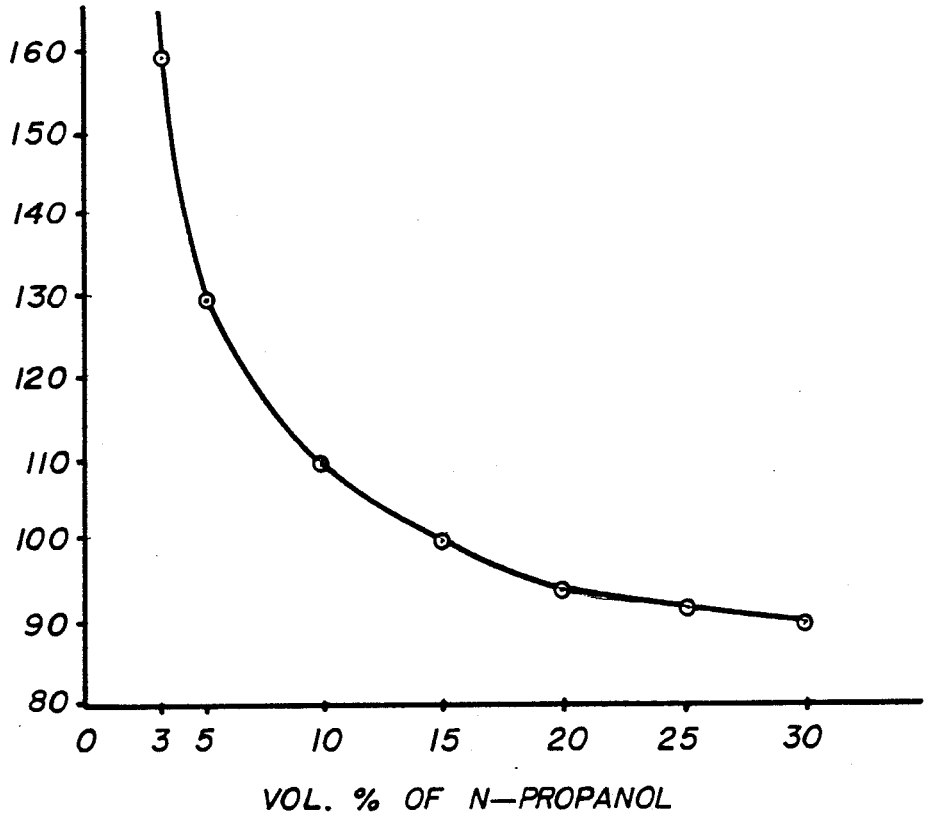
FIG. 2 is a graph of the relationship between the volume percent of alcohol in the eluant and the resultant flash point temperature.

First, a determination was made of the safe percentage of N-propanol that can be inter-mixed with eluting solution to achieve optimum gold desorption. As can be seen from graph of FIG. 2, use of a solution of less than 3% propanol will be a safe procedure since the flash point of such a solution occurs at temperatures above 160° F. Even if a leak does occur, the temperature of the leaking solution (or vapors thereof) will not approach 160° F. when mixed with room temperature air. A series of tests was run over the range of 2–30 percent alcohol as shown. Some water soluble alcohol has been demonstrated to be necessary for efficient desorption of the gold from the carbon. From the test that were conducted, it was found that safe incorporation of 2–3 percent alcohol can be accomplished.

EXAMPLE 2

Figure 3:
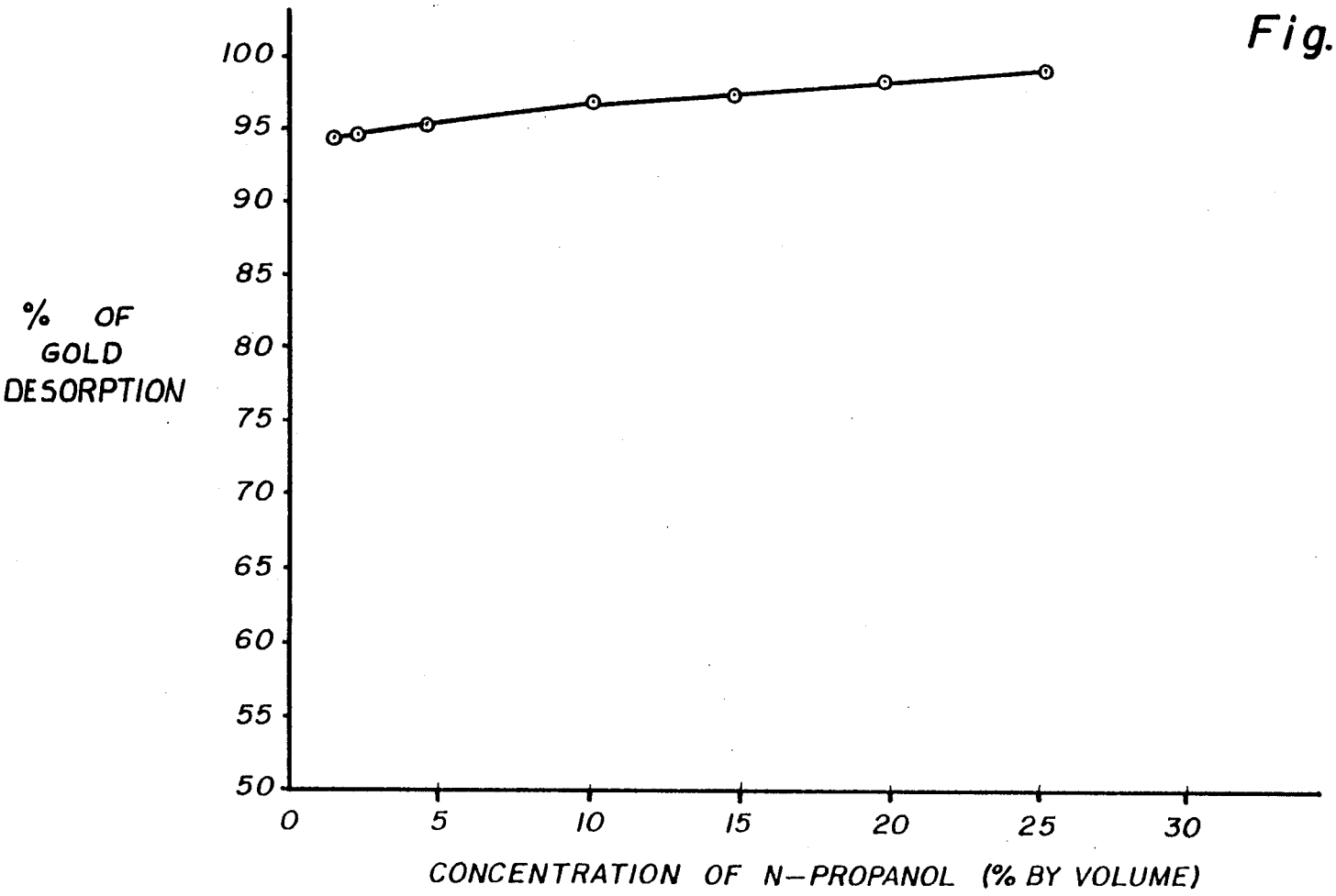
FIG. 3 depicts the relationship between the percentage of gold desorption and the volume percent of alcohol.

For this example several desorption tests were conducted on gold loaded activated coconut shell carbon from an electro-plating gold rinse water. The loaded carbon carried approximately one troy ounce of gold per pound of carbon. Desorption was conducted in a column 12 inches in length and 6 inches in diameter, containing eight inch deep bed of gold-loaded carbon. The eluting solution consisted of a water solution of 3 percent (by weight) NaOH and 0.6 percent (by weight) NaCN with varying proportions of N-Propanol. The volume of eluting solution used was two liters. The operating temperature was about 185° F. The results are shown graphically in FIG. 3. It will be seen that an N-Propanol concentration as low as 2 percent gave excellent gold desorption. Results of these tests sho that concentration of about 2 percent by volume of the alcohol to be quite adequate, with only a small increase in desorption occuring at higher alcohol concentrations.

EXAMPLE 3

Figure 4:
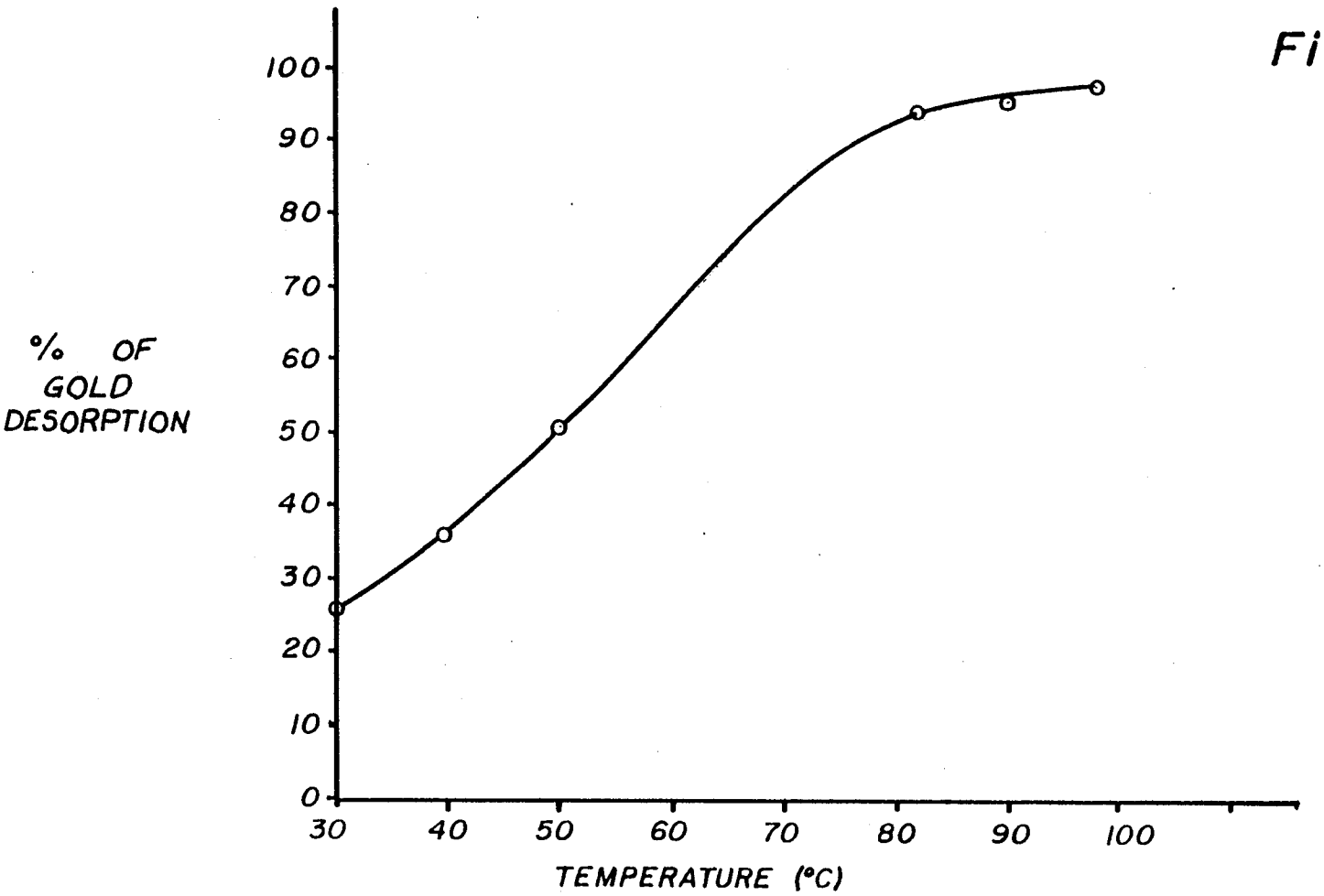
FIG. 4 shows the temperature dependency of the gold desorption process of the instant invention.

Several desorption tests were conducted under conditions similar to those of Example 1, except that all elution solutions contained 20% (by volume) of methanol as the alcohol component, and varying operating temperatures were employed. Results are shown graphically in FIG. 4. It will be seen that the gold desorption is highly temperature dependent and that a temperature of about 85 degrees C. or above is desirable for efficient desorption. This temperature range is also beneficial for destroying bacterial growth in the carbon, which would otherwise have a degrading effect on the gold loading on the carbon.

The preferred embodiment described herein is provided for the purpose of describing a typical implementation of the invention; the scope of the invention is, however, defined by the appended claims and their equivalents.

What is claimed is:

1. A process for desorping of gold from activated carbon comprising contacting the carbon with an eluant consisting essentially of about 2 to 3 percent by volume of a water-soluble alcohol, 97 to 98 percent by volume of deionized water, with at least 25 grams per liter of a strong base and at least 3 grams per liter of sodium cyanide or potassium cyanide dissolved therein, the operating temperature being above 160° F.

2. The process of claim 1 wherein the strong base is sodium hydroxide or potassium hydroxide.

3. The process of claim 1, wherein the alcohol is methanol, ethanol, propanol, or isopropanol.

4. The process of claim 3, wherein the propanol is N-propanol.

5. The process of claim 1, wherein the concentration of strong base is about 30 grams per liter, the concentration of sodium cyanide or potassium cyanide is about 6 grams per liter, and the operating temperature is about 180° F.

6. The process of claim 5 wherein the strong base is sodium hydroxide or potassium hydroxide.

7. The process of claim 5, wherein the alcohol is methanol, ethanol, propanol, or isopropanol.

8. The process of claim 7, wherein the propanol is N-propanol.

* * * * *